US011608609B1

(12) United States Patent
Liu et al.

(10) Patent No.: US 11,608,609 B1
(45) Date of Patent: Mar. 21, 2023

(54) PILE-SIDE LATERAL STATIC LOAD DEVICE

(71) Applicants: Qingdao University of Technology, Qingdao (CN); SPG Qingdao Port Group Company Limited, Qingdao (CN); Hohai University, Nanjing (CN); China University of Petroleum, Qingdao (CN); Institute of Marine Energy Engineering Technology, China Power Engineering Consulting Group CO., LTD, Guangzhou (CN); Innovation Research Institute of Shandong Hi-Speed Group Co., Ltd., Jinan (CN); Zhejiang University, Hangzhou (CN); Northwest A&F University, Shaanxi (CN); China Railway Construction Engineering Group Second Construction Co., Ltd., Qingdao (CN); China Railway Construction Group Co., Ltd., Beijing (CN)

(72) Inventors: Junwei Liu, Qingdao (CN); Dongsheng Jeng, Qingdao (CN); Xianzhang Ling, Qingdao (CN); Dongliang Xing, Qingdao (CN); Jisheng Zhang, Nanjing (CN); Teng Wang, Qingdao (CN); Dayong Li, Qingdao (CN); Bo Liu, Guangzhou (CN); Gongfeng Xin, Jinan (CN); Zhen Guo, Hangzhou (CN); Yi Hong, Hangzhou (CN); Zhengzhong Wang, Shaanxi (CN); Xiuxia Yu, Qingdao (CN); Lingyun Feng, Qingdao (CN); Lin Cui, Qingdao (CN); Zuodong Liang, Qingdao (CN); Hongfeng Guang, Qingdao (CN); Chao Zhang, Qingdao (CN); Ning Jia, Qingdao (CN); Guoxiao Zhao, Qingdao (CN); Rongfu Gao, Beijing (CN); Ming Fang, Beijing (CN)

(73) Assignees: Qingdao University of Technology; SPG Qingdao Port Group Company Limited; Hohai University; China University of Petroleum; Institute of Marine Energy Engineering Technology, China Power Engineering Consulting Group CO., LTD.; Innovation Research Institute of Shandng Hi-Speed Group Co., Ltd.; Zhejiang University; Northwedt A&F University; China Railway Construction Engineering Group Second Construction Co., Ltd.; China Railway Construction Group Co., Ltd.

( * ) Notice: Subject to any disclaimer, the term of this patent is extended or adjusted under 35 U.S.C. 154(b) by 0 days.

(21) Appl. No.: 17/944,235

(22) Filed: Sep. 14, 2022

(51) Int. Cl.

| | |
|---|---|
| ***E02D 7/20*** | (2006.01) |
| ***B66F 3/44*** | (2006.01) |
| ***E02D 33/00*** | (2006.01) |

(52) U.S. Cl.
CPC ..... *E02D 7/20* (2013.01); *B66F 3/44* (2013.01); *E02D 33/00* (2013.01); *E02D 2600/10* (2013.01)

(58) Field of Classification Search
CPC ..... E02D 7/20; E02D 33/00; E02D 2600/10; E02D 13/06; B66F 3/44
See application file for complete search history.

(56) References Cited

U.S. PATENT DOCUMENTS

2015/0114084 A1* 4/2015 He ..... G01L 1/16 73/12.13
2018/0238013 A1* 8/2018 Gu ..... G01N 3/30
(Continued)

FOREIGN PATENT DOCUMENTS

| | | | |
|---|---|---|---|
| CN | 103758159 | A | 4/2014 |
| CN | 112695816 | A | 4/2021 |

*Primary Examiner* — Mahdi H Nejad
(74) *Attorney, Agent, or Firm* — Bayramoglu Law Offices LLC

(57) ABSTRACT

A pile-side lateral static load device includes a jack system, a liftable jack cart, a loading jack fixing system, and a loading system. The jack system includes a jack body. The jack system is installed on the liftable jack cart through the loading jack fixing system. The loading system is installed on the loading jack fixing system, and the loading system includes counter-pressure loading systems and counter-tension loading systems. The pile-side lateral static load device has a simple structure, is convenient to install and operate, and can complete lateral loading and in-situ tests under different pile diameters, different tonnages and different precisions, so as to facilitate a simulation test of in-situ lateral loading of a pile.

8 Claims, 5 Drawing Sheets

(56) References Cited

U.S. PATENT DOCUMENTS

| | | | | |
|---|---|---|---|---|
| 2021/0246623 | A1* | 8/2021 | Lammers | E02D 13/06 |
| 2022/0011205 | A1* | 1/2022 | Yang | G01N 33/24 |

* cited by examiner

PILE-SIDE LATERAL STATIC LOAD DEVICE

TECHNICAL FIELD

The invention relates to the field of pile loading, in particular to a pile-side lateral static load device.

BACKGROUND

With the development of underground construction towards large scale and deep excavation, pile foundations are widely used in subways, foundation pits and even subgrade engineering. In-situ static load testing is the most intuitive and convenient means to analyze the bearing capacity of pile foundations, and is also an important reference index for project inspection and acceptance in each stage of a project. Static load test results are taken more seriously when geological conditions are poor, bedrock is deep and a project is conducted in coastal areas. As an important test to test the lateral bearing capacity of a pile, a lateral static load test needs to be improved in terms of the practicability of supporting experimental instruments.

Existing in-situ lateral static load test instruments have two main development directions. One is to use a simple jack load test, and the scheme is simplified as much as possible while ensuring reliable data, so as to reduce the budget and simplify the process. The other one is to use a complex servo loading system to ensure precision and accuracy, but the cost is increased and the convenience level is lowered. Both of them have the problems that transportation and installation of equipment are difficult, the accuracy of a loading jack is hard to change, adaptation to various pile diameters (common pile diameters vary from 150 mm to 1000 mm) fails, and testing instruments need to be additionally configured and installed. In view of the above situation, it is necessary to develop in-situ lateral static load equipment for a pile which can be assembled and transported according to test requirements and has an adjustable loading range.

SUMMARY

The purpose of the invention is to overcome the above defects in the prior art, and to provide a pile-side lateral static load device, which has a simple structure, is convenient to install and operate, and can complete lateral loading and in-situ tests under different pile diameters, different tonnages and different precisions, so as to facilitate a simulation test of in-situ lateral loading of a pile.

The technical scheme of the invention is as follows: a pile-side lateral static load device comprises a jack system, the jack system comprising a jack body; and further comprises a liftable jack cart, a loading jack fixing system, and a loading system; wherein the jack system is installed on the liftable jack cart through the loading jack fixing system, the loading system is installed on the loading jack fixing system, and the loading system comprises counter-pressure loading systems and/or counter-tension loading systems;

the liftable jack cart comprises a bearing platform, fixed trays and a bearing platform lifting system, the bearing platform is provided with two parallel sliding grooves, the fixed tray is fixed in the sliding grooves through a tray fixing plate, and a bottom of the fixed tray is connected to the tray fixing plate by screws and nuts;

the loading jack fixing system comprises connecting disks located outside two ends of the jack body, and a plurality of telescopic fixing arms connecting the two connecting disks, and the connecting disks are fixedly connected to the ends of the jack body;

the counter-pressure loading system comprises counter-pressure arm connecting disks, a counter-pressure loading arm, a pile pushing arm and pushing arm connecting disks, each counter-pressure arm connecting disk is fixedly connected to an outer side wall surface of the corresponding connecting disk, each pushing arm connecting disk is arranged on an outer side of the corresponding counter-pressure arm connecting disk in parallel, the counter-pressure arm connecting disk and the pushing arm connecting disk are fixedly connected through the counter-pressure loading arm, a center of an outer side wall surface of the pushing arm connecting disk is connected to the pile pushing arm through a one-way movable fixer, and the pile pushing arm rotates in a vertical direction;

the counter-tension loading system comprises a counter-tension loading arm, a tension arm fixing piece, a tension arm, and counter-tension arm connecting disks, the counter-tension arm connecting disks are fixedly connected to the outer side wall surfaces of the two connecting disks, the counter-tension loading arm is in a frame shape, the counter-tension loading arm has a side frame edge fixedly connected to an outer side surface of the counter-tension arm connecting disk on one side, as well as side frame edge located on an outer side of the counter-tension arm connecting disk on the other side and connected to the tension arm through the tension arm fixing piece, which is rotatably arranged on a frame edge of the counter-tension loading arm, the tension arm rotates in the vertical direction, and the tension arm is an in-pile pulling arm or an ex-pile pulling ring.

In the invention, the jack system further comprises a jack cylinder and a motor, the jack body is connected to the jack cylinder through a connecting line, and the jack body is placed on the liftable jack cart.

The bearing platform is placed on a ground and supported by the bearing platform lifting system, the bearing platform lifting system comprises a connecting rod lifting mechanism and a bottom frame, a bottom of a connecting rod mechanism is connected to the bottom frame, a top of the connecting rod mechanism is fixedly connected to a bottom surface of the bearing platform, the connecting rod lifting mechanism comprises a plurality of connecting rods connected end to end in the vertical direction, and a bottom surface of the bottom frame is provided with a plurality of rotating wheels.

Two ends of the telescopic fixing arm are fixedly connected to the connecting disks by fixing bolts respectively.

Outer sides of the two connecting disks are each provided with a plurality of bolts, and detachable connection between the connecting disks and the counter-pressure loading system and/or the counter-tension loading system is realized through the bolts.

When the tension arm is an in-pile pulling arm, the in-pile pulling arm faces the jack system; and when the tension arm is an ex-pile pulling ring, the ex-pile pulling ring faces an outer side of the whole device.

When the counter-tension loading system adopts an internal counter-tension mode, the counter-pressure loading system and the counter-tension loading system may be installed at two ends of the jack system at the same time, in this case, the counter-pressure arm connecting disk of the counter-pressure loading system and the counter-tension arm connecting disk of the counter-tension loading system are of an integrated structure, ends of the counter-tension loading arm and the counter-pressure loading arm are both fixed to the counter-pressure arm connecting disk, and the in-pile pulling arm is located on an outer side of the pile pushing arm.

The pile-side lateral static load device further comprises a data acquisition system, the data acquisition system comprises pressure sensors, a stress acquisition instrument, laser displacement meters and a displacement acquisition instrument, the stress acquisition instrument and the displacement acquisition instrument are both installed on the bearing platform, the pressure sensors are installed at ends of fixed connection parts between the jack body and the connecting disks, the laser displacement meters are installed on the outer side wall surfaces of the connecting disks or the outer side wall surfaces of the pushing arm connecting disks, and the laser displacement meter comprises an upper laser displacement meter and a lower laser displacement meter; and assuming that a reading of the upper laser displacement meter is $S_1$, a reading of the lower laser displacement meter is $S_2$, and a vertical distance between the two laser displacement meters is d, an inclination angle of the pile is:

$$\alpha = \tan^{-1}\frac{s_1 - s_2}{d}.$$

In the counter-pressure loading system, the counter-pressure arm connecting disk is provided with a data acquisition system reserved wire hole, a data transmission line has an end connected to the laser displacement meter, as well as an end passing through the data acquisition system reserved wire hole and connected to the displacement acquisition instrument, and the data transmission line transmits displacement values measured by the upper laser displacement meter and the lower laser displacement meter to the laser displacement meter.

The invention has the following beneficial effects:

(1) the structure is simple, operation is easy, and because the loading system comprises a counter-pressure loading system and a counter-tension loading system, working under various loading conditions can be realized;

(2) the column jack, as a loading core, can be adjusted according to the precision required by an experiment, so as to meet the requirements of model tests at various sites and even indoor model tests, and the position and rotation angle of a fixed pushing disk in the device can be adjusted to adapt to jacks of various types and sizes;

(3) the device can acquire and output data in real time through the data acquisition system, so as to realize real-time analysis of the test together with an external receiving and processing device; and (4) all components of the device are detachably connected, which facilitates installation, usage, transportation and storage, and only 2-3 people are required to use the device.

To sum up, by changing the model and quantity of jacks and replacing corresponding accessories, the device can complete a loading and in-situ test and quantity measurement under pile diameters ranging from 150 mm to 1000 mm, tonnages ranging from 1 to 200 and different loads, so as to simulate actual loads.

Figure 1:
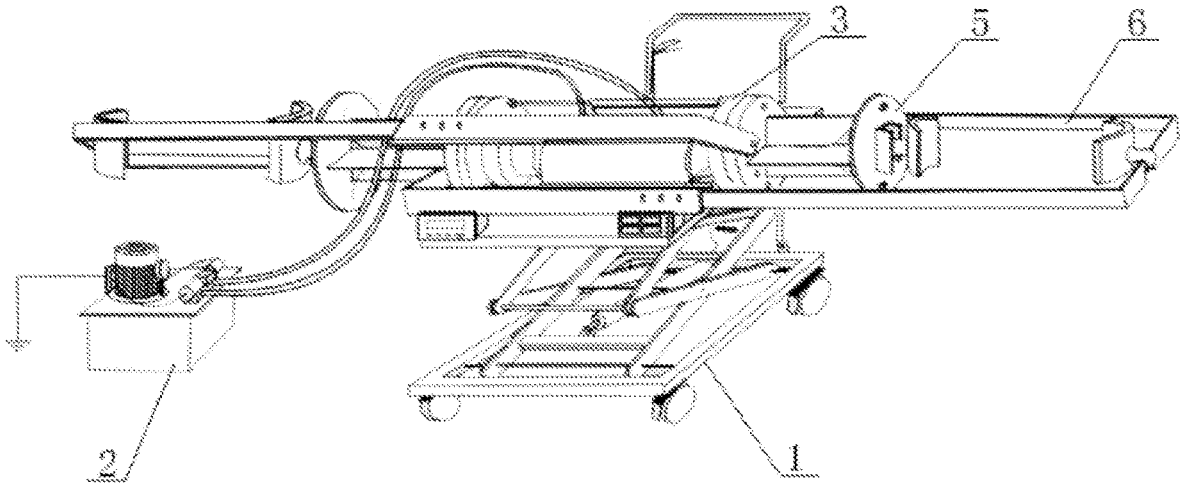
FIG. 1 is a structural diagram of a device when a counter-tension loading system adopting an internal counter-tension mode is combined with a counter-pressure loading system.

In the drawings: 1 liftable jack cart; 101 rotating wheel; 102 bearing platform; 103 sliding groove; 104 fixed tray; 105 tray fixing plate; 106 bearing platform lifting system; 2 jack system; 201 jack body; 202 jack cylinder; 203 connecting line; 3. loading jack fixing system; 301 fixing bolt; 302 telescopic fixing arm; 303 connecting disk; 4 data acquisition system; 401 pressure sensor; 402 stress acquisition instrument; 403 laser displacement meter; 4031 upper laser displacement meter; 4032 lower laser displacement meter; 404 displacement acquisition instrument; 5 counter-pressure loading system; 501 counter-pressure arm connecting disk; 502 data acquisition system reserved wire hole; 503 data transmission line; 504 counter-pressure loading arm; 505 pile pushing arm; 506 one-way movable fixer; 507 pushing arm connecting disk; 6 counter-tension loading system; 601 counter-tension loading arm; 602 tension arm fixing piece; 603 in-pile pulling arm; 604 counter-tension arm connecting disk; 605 ex-pile pulling ring.

DETAILED DESCRIPTION OF THE EMBODIMENTS

In order to make the above objects, features and advantages of the invention better understood, the specific embodiments of the invention will be described in detail below with reference to the accompanying drawings.

In the following description, specific details are set forth in order to gain a comprehensive understanding of the invention. However, the invention can be implemented in many other ways different from those described here, and those skilled in the art can make similar extension without violating the connotation of the invention. Therefore, the invention is not limited by the specific embodiments disclosed below.

A pile-side lateral static load device provided by the invention comprises a liftable jack cart, a jack system, a loading jack fixing system, and a loading system, wherein the jack system is detachably installed on the liftable jack cart through the loading jack fixing system, the loading system is installed on the loading jack fixing system, and the loading system performs pile loading through the action force of the jack system. According to different loading forms, directions and pile distances, there are two forms: counter-pressure and counter-tension. In the invention, the loading system comprises counter-pressure loading systems and counter-tension loading systems, and the counter-pressure loading system and the counter-tension loading system can be simultaneously or separately installed on the loading jack fixing system. Counter-tension pile loading can be further divided into an internal counter-tension loading mode and an external counter-tension loading mode according to different pile sizes.

FIG. 1 is a structural diagram of the device when a counter-tension loading system adopting an internal counter-tension mode is combined with a counter-pressure loading system. The device comprises a liftable jack cart 1, a jack system 2, a loading jack fixing system 3, a data acquisition system 4, counter-pressure loading systems 5 and counter-tension loading systems 6. The loading jack fixing system 3 is arranged on the jack cart 1 and the jack system 2 is installed on the loading jack fixing system 3. The counter-pressure loading system 5 and/or the counter-tension loading system 6 is connected to the loading jack fixing system 3, that is, the counter-pressure loading system 5 and the counter-tension loading system 6 can be separately or simultaneously connected to the loading jack fixing system 3. In FIG. 1, the counter-tension loading system 6 adopting the internal counter-tension mode and the counter-pressure loading system 5 can be simultaneously connected to the loading jack fixing system 3.

Figure 2:
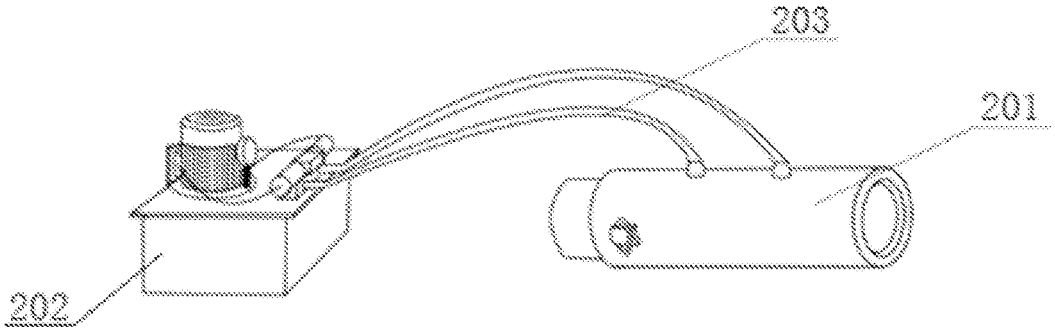
FIG. 2 is a structural diagram of a jack system.

As shown in FIG. 2, the jack system 2 comprises a column jack body 201, a jack cylinder 202 and a motor. The jack body 201 is connected to the jack cylinder 202 through a connecting line 203, and the jack body 201 is placed on the liftable jack cart 1.

Figure 3:
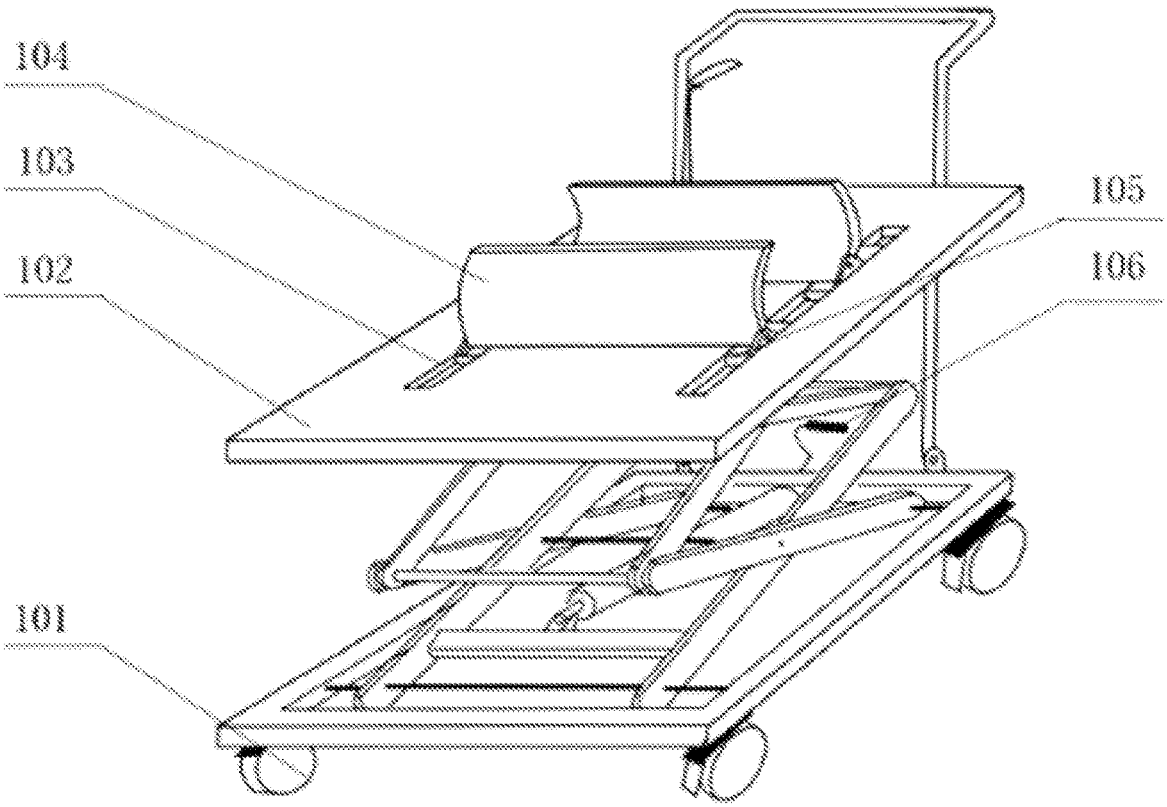
FIG. 3 is a structural diagram of a liftable jack cart.

As shown in FIG. 3, the liftable jack cart 1 comprises a bearing platform 102, fixed trays 104 and a bearing platform lifting system 106. The bearing platform 102 is placed on the ground and supported by the bearing platform lifting system 106, which drives the bearing platform 102 to rise or fall, thus realizing the height adjustment of the bearing platform 102. In this embodiment, the bearing platform lifting system 106 comprises a connecting rod lifting mechanism and a bottom frame, a bottom of a connecting rod mechanism is connected to the bottom frame, a top of the connecting rod mechanism is fixedly connected to a bottom surface of the bearing platform 102, the connecting rod lifting mechanism comprises a plurality of connecting rods connected end to end in the vertical direction, and the lifting of the bearing platform is realized by folding and unfolding of the connecting rods. A bottom surface of the bottom frame is provided with rotating wheels 101, which can be fixed or rotated. The cart can be moved to a designated position through the rotating wheels 101. When the cart moves to the designated position, the rotating wheels 101 are fixed, so that the position of the cart is fixed. By arranging the rotating wheels 101, the force and displacement are on the same straight line during loading, and the static position at an uneven site is ensured.

The bearing platform 102 is provided with two parallel sliding grooves 103, and the fixed trays 104 are arranged in the sliding grooves 103 through a tray fixing plate 105. A bottom of the fixed tray 104 is connected to the tray fixing plate 105 by screws and nuts. When the nuts are loosened, the fixed tray 104 is rotationally connected to the tray fixing plate 105. When the nuts are tightened, the fixed tray 104 and the tray fixing plate 105 are fixedly connected. The tray fixing plate 105 is located in the sliding grooves 103 and slides in the sliding grooves 103, and the tray fixing plate 105 can be fixed in the sliding grooves 103 by bolts. When jack bodies 201 of different sizes/tonnages are placed in the two fixed trays 104, the nuts are loosened, the fixed trays 104 are rotated to an appropriate angle, and a distance between the two fixed trays 104 is adjusted by the tray fixing plate 105, so that an inner surface of the fixed tray 104 is attached to an outer surface of the jack. Therefore, the liftable jack cart can adapt to jack bodies of different sizes or tonnages, so that the jack body 201, as the loading core, can be adjusted according to the precision required by a test, so as to meet the requirements of model tests at various sites and even indoor model tests.

Figure 4:
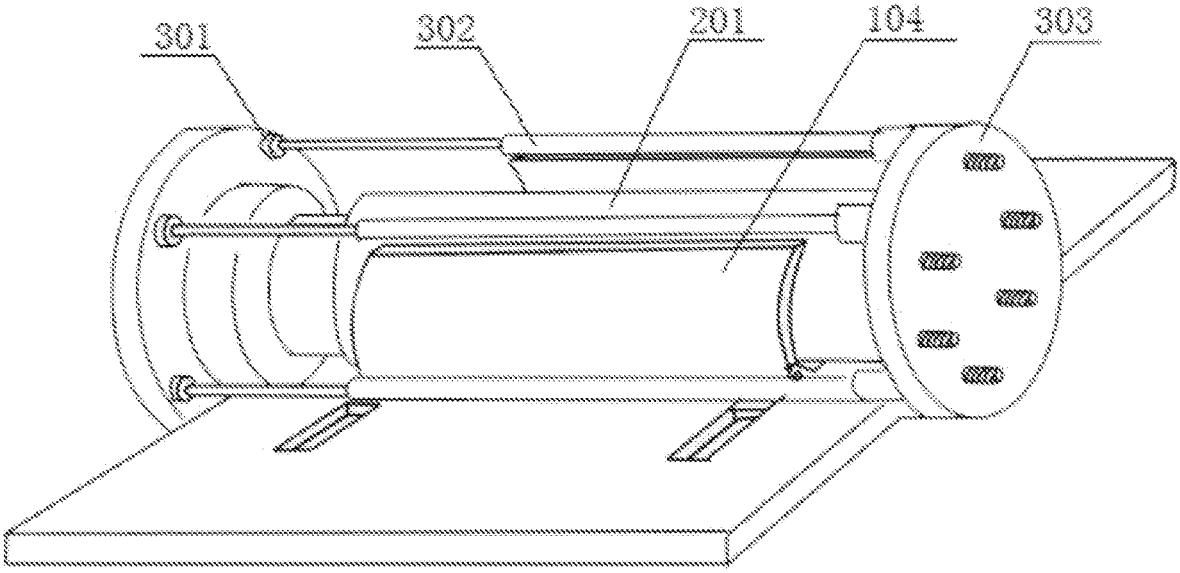
FIG. 4 is a structural diagram of a loading jack fixing system.

As shown in FIG. 4, the loading jack fixing system 3 comprises connecting disks 303 located outside two ends of the jack body, and a plurality of telescopic fixing arms 302 connecting the two connecting disks 303, and the connecting disks 303 are fixedly connected to the ends of the jack body 201. Two ends of the telescopic fixing arm 302 are fixedly connected to the connecting disks 303 by fixing bolts 301, so that the connecting disks 303 can be removed through rotation, allowing the jack body 201 to be placed on the liftable jack cart. In this embodiment, outer sides of the two connecting disks 303 are respectively provided with six bolts, and detachable connection between the connecting disks 303 and the counter-pressure loading system and/or the counter-tension loading system is realized through the bolts.

Figure 5:
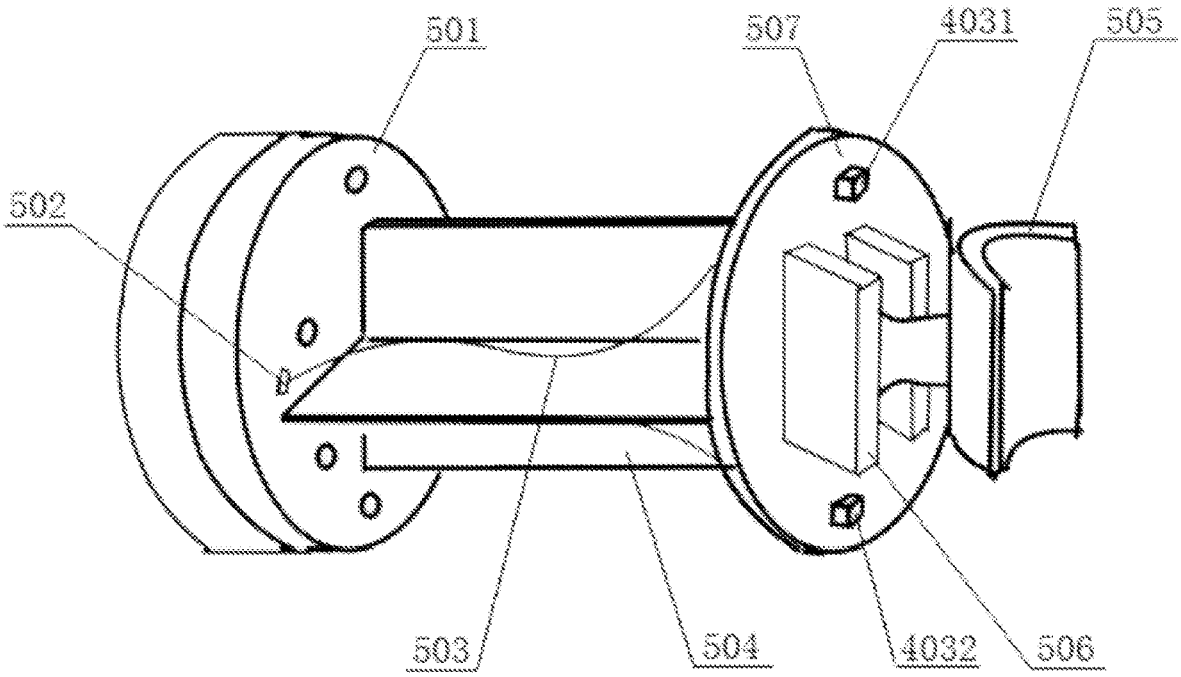
FIG. 5 is a structural diagram of a single-side counter-pressure loading system.
Figure 6:
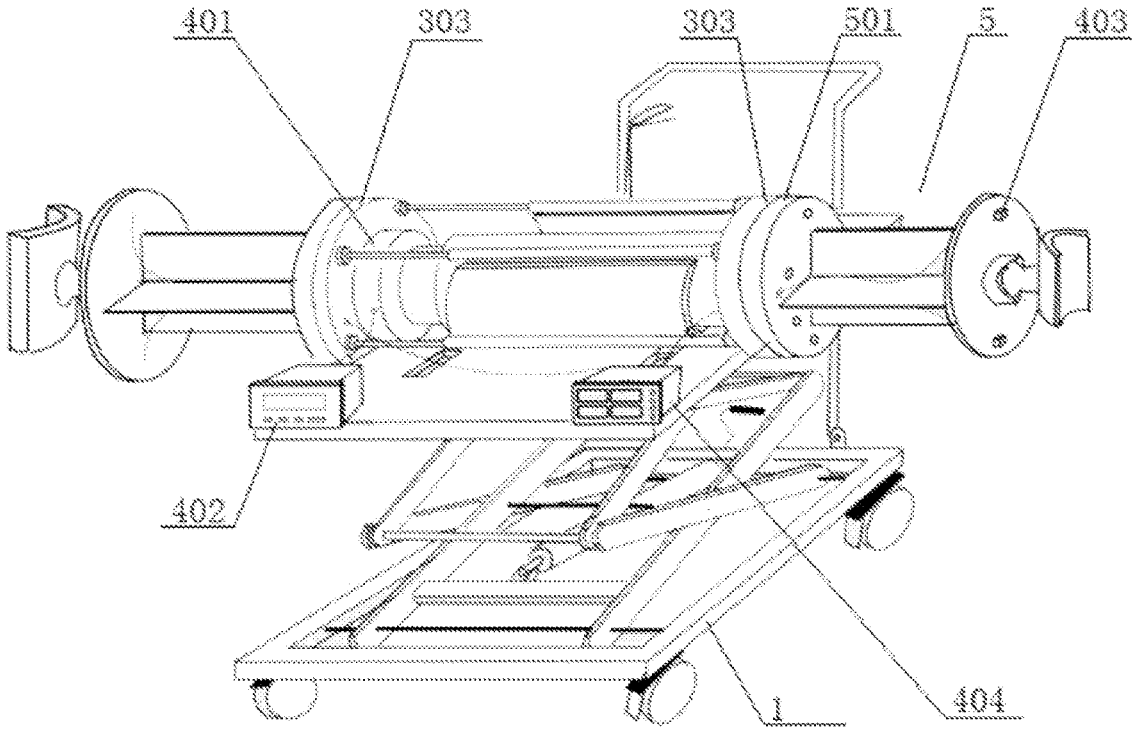
FIG. 6 is a structural diagram of the device when a counter-pressure mode is adopted.

As shown in FIGS. 5 and 6, the outer sides of the connecting disks 303 of the loading jack fixing system 3 are fixedly connected to the counter-pressure loading systems, and counter-pressure loading of a pile is realized through the counter-pressure loading systems arranged at two ends. FIG. 5 shows the counter-pressure loading system on one side, comprising counter-pressure arm connecting disks 501, a counter-pressure loading arm 504, a pile pushing arm 505 and pushing arm connecting disks 507, the counter-pressure arm connecting disks 501 are fixedly connected to the connecting disks 303 by bolts, each pushing arm connecting disk 507 is arranged on an outer side of the corresponding counter-pressure arm connecting disk 501 in parallel, and the counter-pressure arm connecting disk 501 and the pushing arm connecting disk 507 are fixedly connected through the counter-pressure loading arm 504. The counter-pressure loading arm 504 is made of Q345 steel, which is rigid enough and has a weight that meets the load requirements of the cart. A center of an outer side wall surface of the pushing arm connecting disk 507 is connected to the pile pushing arm 505 through a one-way movable fixer 506, and the pile pushing arm 505 can rotate in a vertical direction. The shape and size of the pile pushing arm are suitable for pile loading, and its rigidity and weight should meet the loading requirements, so as to realize axial pile loading and ensure the stability of a loading direction after deflection.

As shown in FIG. 6, when the jack system 2 operates, the jack body 201 applies outward thrust to the counter-pressure loading system connected to two ends of the jack body. At this point, the pile pushing arm 505 of the counter-pressure loading system applies outward thrust to the pile outside, and the relative displacement change data of the pile are collected during counter-pressure loading of the pile.

As shown in FIGS. 7-10, outer sides of the connecting disks 303 of the loading jack fixing system 3 are respectively fixedly connected to the counter-tension loading systems, and counter-tension loading of the pile is realized through the counter-tension loading systems arranged at two ends. The counter-tension loading system comprises a counter-tension loading arm 601, a tension arm fixing piece 602, a tension arm, and counter-tension arm connecting disks 604, and the counter-tension arm connecting disks 604 are located on the outer sides of the two connecting disks 303 and fixedly connected to the two connecting disks 303; the counter-tension loading arm 601 is in a frame shape, one side frame edge of the counter-tension loading arm 601 is fixedly connected to an outer side surface of the counter-tension arm connecting disk 604 on one side by bolts, the counter-tension arm connecting disks 604 is detachable by means of the bolts, the other side frame edge of the counter-tension loading arm 601 is located on an outer side of the counter-tension arm connecting disk 604 on the other side and is connected to the tension arm through the tension arm fixing piece 602, which is rotatably arranged on a frame edge of the counter-tension loading arm 601; and the tension arm fixing piece 602 can also be fixedly connected to the counter-tension loading arm 601 by screws and nuts, and the tension arm is hinged to the tension arm fixing piece 602, so that the tension arm can rotate in the vertical direction.

Figure 7:
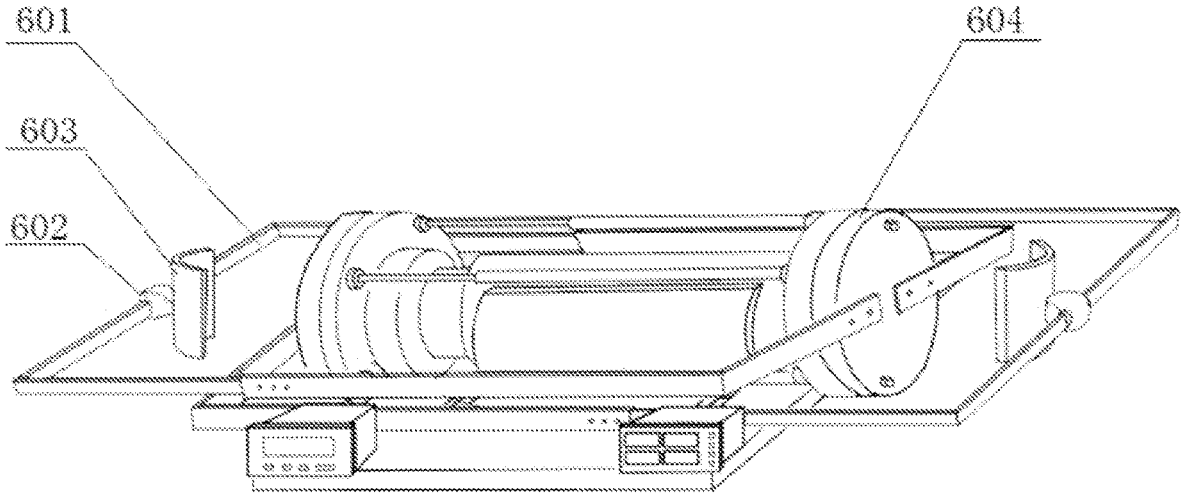
FIG. 7 is a structural diagram of a counter-tension loading system adopting an internal counter-tension mode.
Figure 8:
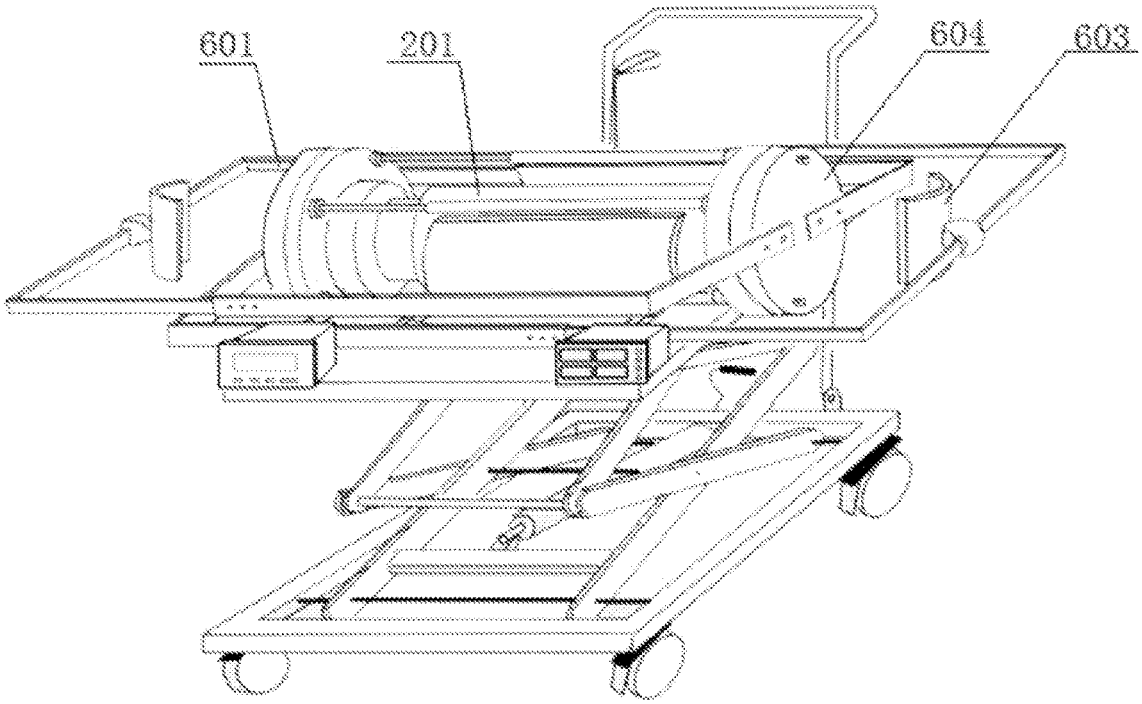
FIG. 8 is a structural diagram of the device when an internal counter-tension mode is adopted.

The tension arm may be an in-pile pulling arm 603 or an ex-pile pulling ring 605. For tubular piles with a diameter less than 300 mm, the in-pile pulling arm 603 is adopted, the tension arm fixing piece 602 is rotated to make the in-pile pulling arm 603 connected to the tension arm fixing piece rotate towards the jack system, and nuts are tightened to fix the position of the tension arm fixing piece 602. At this point, the counter-tension loading system adopts an internal counter-tension mode, as shown in FIGS. 7 and 8. When the jack system 2 operates, the jack body 201 exerts outward thrust on the connecting disks 303 at two ends and the counter-tension arm connecting disks 604. At this point, the in-pile pulling arm 603 on the counter-tension loading arm 601 connected to the counter-tension arm connecting disk 604 moves towards the jack system, and the in-pile pulling arm 603 exerts inward pulling force on the pile from the outside of the pile. During internal counter-tension loading of the pile, the relative displacement change data of the pile are collected.

When the counter-tension loading system adopts an internal counter-tension mode, the counter-pressure loading system and the counter-tension loading system can be installed at two ends of the jack system at the same time, as shown in FIG. 1, in this case, the counter-pressure arm connecting disk of the counter-pressure loading system and the counter-tension arm connecting disk of the counter-tension loading system are of an integrated structure, that is, ends of the counter-tension loading arm and the counter-pressure loading arm are both fixed to the counter-pressure arm connecting disk 501, and the in-pile pulling arm 603 is located on an outer side of the pile pushing arm 505. After the positions of the in-pile pulling arm and the pile pushing arm are adjusted, the counter-pressure loading system and the counter-tension loading system adopting the internal counter-tension mode can work together to achieve the effect of continuous and slow loading in a tension-pressure circulation mode.

Figure 9:
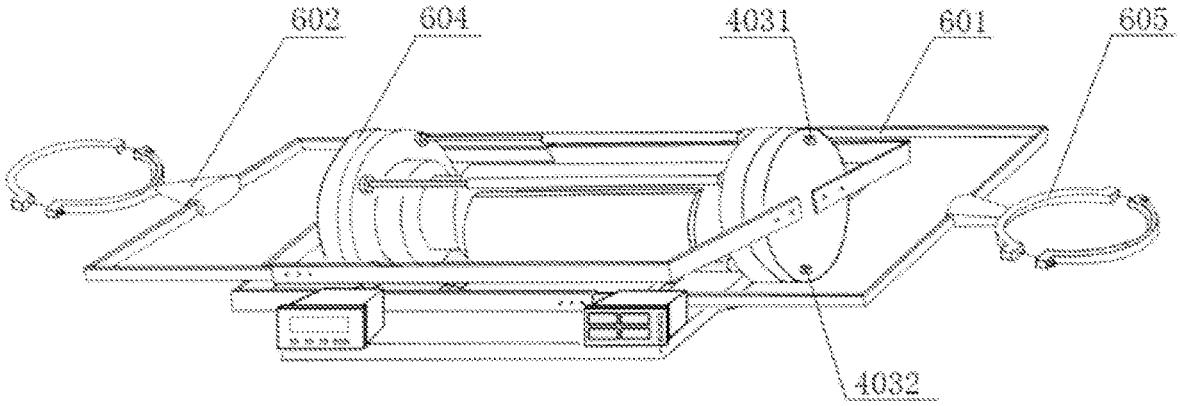
FIG. 9 is a structural diagram of a counter-tension loading system adopting an external counter-tension mode.
Figure 10:
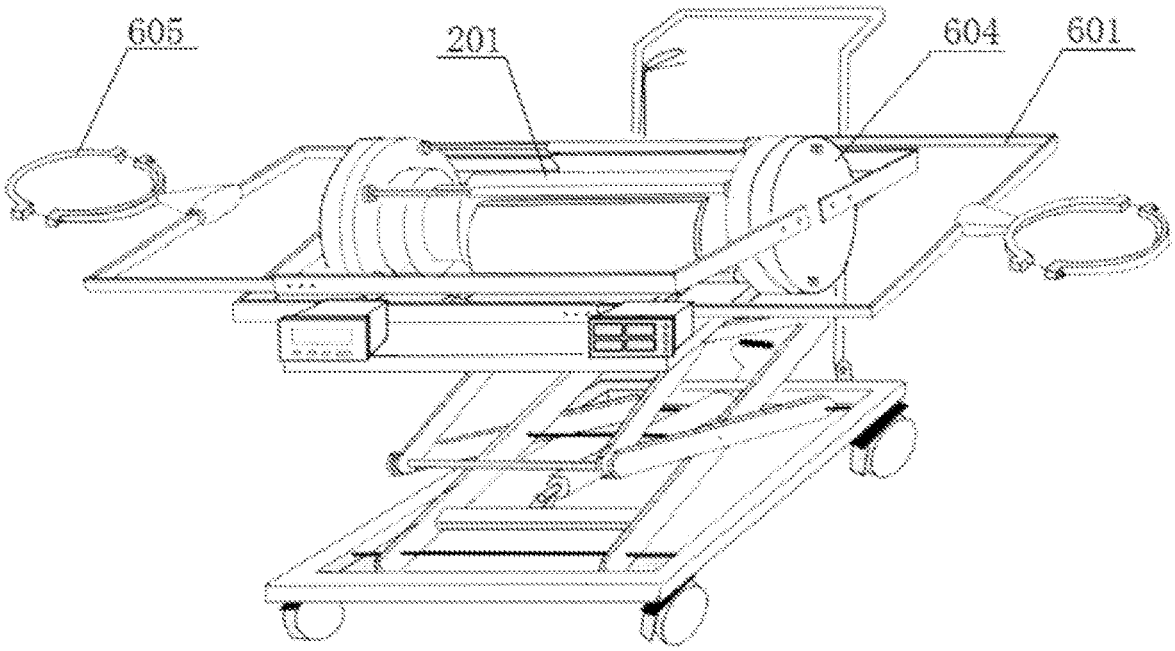
FIG. 10 is a structural diagram of the device when an external counter-tension mode is adopted.

For tubular piles with a diameter greater than 300 mm, the tension arm is the ex-pile pulling ring 605 which is annular. During loading, the ex-pile pulling ring 605 is sleeved outside the tubular pile, and ex-pile pulling rings of corresponding sizes are selected according to the external size of the tubular pile. The tension arm fixing piece 602 is rotated to make the ex-pile pulling ring 605 connected to the tension arm fixing piece rotate towards the outside of the whole device, and nuts are tightened to fix the position of the tension arm fixing piece 602. At this point, the counter-tension loading system adopts an external counter-tension mode, as shown in FIGS. 9 and 10. When the jack system 2 operates, the jack body 201 exerts outward thrust on the connecting disks 303 at two sides and the counter-tension arm connecting disks 604. At this point, the ex-pile pulling ring 605 on the counter-tension loading arm 601 connected to the counter-tension arm connecting disk 604 directly applies inward pulling force to the tubular pile in the ring. During external counter-tension loading of the pile, the relative displacement change data of the pile are collected.

When an external counter-tension loading mode is adopted, the counter-pressure loading system and the counter-tension loading system cannot be installed on the device at the same time. When the pile needs to be subjected to counter-pressure loading, the counter-tension loading system is detached from the device and the counter-pressure loading system is installed. When the pile needs to be subjected to counter-tension loading, the counter-pressure loading system is detached from the device and the counter-tension loading system is installed.

The device also comprises a data acquisition system 4, the data acquisition system comprises pressure sensors 401, a stress acquisition instrument 402, laser displacement meters 403 and a displacement acquisition instrument 404, the stress acquisition instrument 402 and the displacement acquisition instrument 404 are both installed on the bearing platform 102, the pressure sensors 401 are installed at ends of fixed connection parts between the jack body 201 and the connecting disks 303 to measure a loading value of the jack, and the laser displacement meters 403 are installed on the outer side wall surfaces of the connecting disks 303 or the outer side wall surfaces of the pushing arm connecting disks 507. When counter-pressure loading is conducted on the pile, the laser displacement meters 403 are installed on the outer side wall surfaces of the pushing arm connecting disks 507. When counter-tension loading is conducted on the pile, the laser displacement meters 403 are installed on the outer side wall surfaces of the connecting disks 303. The laser displacement meter comprises an upper laser displacement meter 4031 and a lower laser displacement meter 4032. By measuring the relative displacement transformation of the pile, an inclination angle of the pile can be calculated. In this application, assuming that a reading of the upper laser displacement meter 4031 is $S_1$, a reading of the lower laser displacement meter 4032 is $S_2$, and a vertical distance between the two laser displacement meters is d, the inclination angle of the pile is $$\alpha = \tan^{-1}\frac{s_1 - s_2}{d}.$$

As shown in FIG. 5, in the counter-pressure loading system, the counter-pressure arm connecting disk 501 is provided with a data acquisition system reserved wire hole 502, one end of a data transmission line 503 is connected to the laser displacement meter, the other end passes through the data acquisition system reserved wire hole 502 and is connected to the displacement acquisition instrument 404, and the data transmission line 503 transmits displacement values measured by the upper laser displacement meter 4031 and the lower laser displacement meter 4032 to the laser displacement meter.

When the device is in use, the corresponding loading system is selected according to the required loading mode of the pile. When pressure loading needs to be conducted on the pile, the counter-pressure loading systems are installed at two ends of the jack system. When tension loading needs to be conducted on the pile, the counter-tension loading systems should be installed at two ends of the jack system. Appropriate tension arms should be selected according to the size of the pile. When the pile is small, the internal counter-tension mode should be adopted, and an in-pile pulling arm should be adopted. When the pile is large, the external counter-tension mode is adopted, and an ex-pile pulling ring should be adopted. The counter-pressure loading system and the counter-tension loading system adopting the internal counter-tension mode can be installed at two ends of the jack system at the same time, thus realizing continuous and slow loading in a tension-pressure circulation mode.

The pile-side lateral static load device provided by the invention has been introduced in detail. In this specification, specific examples are used to explain the principle and implementation of the invention, and the description of the above embodiments is only used to help understand the method of the invention and its core ideas. It should be pointed out that for those of ordinary skill in the art, multiple improvements and modifications may be made to the invention without departing from the principle of the invention, and these improvements and modifications also fall within the scope of protection of the claims of the invention. The above description of the disclosed embodiments enables those skilled in the art to implement or use the invention. Various modifications to these embodiments will be apparent to those skilled in the art, and the general principles defined herein may be implemented in other embodiments without departing from the spirit or scope of the invention. Therefore, the invention should not be limited to the embodiments shown herein, but should accord with the widest scope consistent with the principles and novel features disclosed herein.

What is claimed is:

1. A pile-side lateral static load device, comprising a jack system, a liftable jack cart, a loading jack fixing system, and a loading system; the jack system comprising a jack body; wherein the jack system is installed on the liftable jack cart through the loading jack fixing system, the loading system is installed on the loading jack fixing system, and the loading system comprises two counter-pressure loading systems and two counter-tension loading systems;

the liftable jack cart comprises a bearing platform, fixed trays and a bearing platform lifting system, wherein the bearing platform is provided with two parallel sliding grooves, each of the fixed trays are fixed in the sliding grooves through a respective tray fixing plate, and a bottom of each of the fixed trays is connected to the respective tray fixing plate by screws and nuts;

the loading jack fixing system comprises two connecting disks located outside two ends of the jack body, and a plurality of telescopic fixing arms connecting the two connecting disks, wherein the two connecting disks are fixedly connected to the ends of the jack body;

each of the two the counter-pressure loading systems comprises a counter-pressure arm connecting disk, a counter-pressure loading arm, a pile pushing arm and a pushing arm connecting disk, wherein each counter-pressure arm connecting disk is fixedly connected to an outer side wall surface of the corresponding connecting disk of the two connecting disks of the loading jack fixing system, each pushing arm connecting disk is arranged on an outer side of the corresponding counter-pressure arm connecting disk in parallel, the counter-pressure arm connecting disk and the pushing arm connecting disk are fixedly connected through the counter-pressure loading arm, a center of an outer side wall surface of the pushing arm connecting disk is connected to the pile pushing arm through a one-way movable fixer, and the pile pushing arm rotates in a vertical direction;

each of the two counter-tension loading systems comprises a counter-tension loading arm, a tension arm fixing piece, a tension arm, and a counter-tension arm connecting disk fixedly connected to the outer side wall surface of a respective one of the two connecting disks, wherein the counter-tension loading arm is in a frame shape and has a side frame edge fixedly connected to an outer side surface of the counter-tension arm connecting disk on one side, as well as a side frame edge located on an outer side of the counter-tension arm connecting disk on the other side and connected to the tension arm through the tension arm fixing piece, wherein the tension arm fixing piece is rotatably arranged on a frame edge of the counter-tension loading arm, the tension arm rotates in the vertical direction, and the tension arm is an in-pile pulling arm or an ex-pile pulling ring; and when the counter-tension loading system adopts an internal counter-tension mode, the two counter-pressure loading systems and the two counter-tension loading systems are installed at two ends of the jack system at the same time, in this case, the counter-pressure arm connecting disk of the respective counter-pressure loading system and the counter-tension arm connecting disk of the respective counter-tension loading system are of an integrated structure, ends of the counter-tension loading arm and the counter-pressure loading arm are both fixed to the counter-pressure arm connecting disk, and the in-pile pulling arm is located on an outer side of the pile pushing arm.

2. The pile-side lateral static load device according to claim 1, wherein the jack system further comprises a jack cylinder and a motor, wherein the jack body is connected to the jack cylinder through a connecting line, and the jack body is placed on the liftable jack cart.

3. The pile-side lateral static load device according to claim 1, wherein the bearing platform is placed on a ground and supported by the bearing platform lifting system, and the bearing platform lifting system comprises a connecting rod lifting mechanism and a bottom frame, wherein a bottom of a connecting rod mechanism is connected to the bottom frame, and a top of the connecting rod mechanism is fixedly connected to a bottom surface of the bearing platform; the connecting rod lifting mechanism comprises a plurality of connecting rods connected end to end in the vertical direction; and a bottom surface of the bottom frame is provided with a plurality of rotating wheels.

4. The pile-side lateral static load device according to claim 1, wherein two ends of each telescopic fixing arm of plurality of telescopic fixing arms are fixedly connected to the two connecting disks by fixing bolts respectively.

5. The pile-side lateral static load device according to claim 1, wherein outer sides of the two connecting disks are each provided with a plurality of bolts, and detachable connection between the two connecting disks and the two counter-pressure loading systems and/or the two counter-tension loading systems is realized through the plurality of bolts.

6. The pile-side lateral static load device according to claim 1, wherein when the tension arm is the in-pile pulling arm, the in-pile pulling arm faces the jack system; and when the tension arm is the ex-pile pulling ring, the ex-pile pulling ring faces an outer side of the pile-side lateral static load device.

7. The pile-side lateral static load device according to claim 1, further comprising a data acquisition system, wherein the data acquisition system comprises pressure sensors, a stress acquisition instrument, laser displacement meters and a displacement acquisition instrument, wherein the stress acquisition instrument and the displacement acquisition instrument are both installed on the bearing platform, the pressure sensors are installed at ends of fixed connection parts between the jack body and the two connecting disks, the laser displacement meters are installed on the outer side wall surfaces of the two connecting disks or the outer side wall surfaces of the pushing arm connecting disks, and each of the laser displacement meters comprises an upper laser displacement meter and a lower laser displacement meter; and assuming that a reading of the upper laser displacement meter is $S_1$, a reading of the lower laser displacement meter is $S_2$, and a vertical distance between the two laser displacement meters is d, an inclination angle of the pile is:

$$\alpha = \tan^{-1}\frac{s_1 - s_2}{d}.$$

8. The pile-side lateral static load device according to claim 7, wherein in each of the two the counter-pressure loading systems, the counter-pressure arm connecting disk is provided with a data acquisition system reserved wire hole, a data transmission line has an end connected to a respective laser displacement meter of the laser displacement meters, as well as an end passing through the data acquisition system reserved wire hole and connected to the displacement acquisition instrument, and the data transmission line transmits displacement values measured by the corresponding upper laser displacement meter and the corresponding lower laser displacement meter to the respective laser displacement meter of the laser displacement meters.

* * * * *